US006050321A

United States Patent [19]

Koks et al.

[11] Patent Number: 6,050,321

[45] Date of Patent: Apr. 18, 2000

[54] CORD LOCK

[75] Inventors: Marinus Frederik Koks, Rotterdam; Petrus Gerardus Maria van der Mars, Gouda, both of Netherlands

[73] Assignee: Hunter Douglas International NV, Netherlands

[21] Appl. No.: 09/229,880

[22] Filed: Jan. 14, 1999

[30] Foreign Application Priority Data

Jan. 14, 1998 [EP] European Pat. Off. ..... 98200075

[51] Int. Cl.[7] ..... E06B 9/324

[52] U.S. Cl. ..... 160/178.2 R

[58] Field of Search ..... 160/178.2 R, 168.1 R, 160/173 R, 84.01, 178.1 R

[56] References Cited

U.S. PATENT DOCUMENTS

| | | | |
|---|---|---|---|
| 4,646,808 | 3/1987 | Anderson | 160/178.2 R |
| 4,651,795 | 3/1987 | Valle et al. | 160/178.2 R |
| 4,719,956 | 1/1988 | Valle . | |
| 4,945,970 | 8/1990 | Marocco | 160/178.2 R |
| 5,156,196 | 10/1992 | Corey et al. | 160/178.2 R |
| 5,263,528 | 11/1993 | Patel | 160/178.2 R |

FOREIGN PATENT DOCUMENTS 2271600 4/1994 United Kingdom .

*Primary Examiner*—David M. Purol
*Attorney, Agent, or Firm*—Dorsey & Whitney LLP

[57] ABSTRACT

A cord lock for fitment to the end of a head rail of a blind, the cord lock including a base element, a cap structure on the base element and together with the base element and together with the base element defining therebetween a cord inlet, a cord outlet and a cord passage extending therebetween, a cord guide surface formed in the base element and extending inwardly of the cord lock from the cord outlet, a locking roller and roller guide walls formed in the cap structure defining a path along which the locking roller may move, the path being adjacent to and inclined with the cord guide surface such that the roller moves closer to the cord guide surface whilst moving away from the cord outlet, wherein with the cord lock oriented in use such that the roller moves under gravity away from the cord guide surface, movement of a cord inwardly from the cord outlet along the cord guide surface will cause the roller to move towards the cord guide surface and pinch the cord therebetween.

13 Claims, 5 Drawing Sheets

CORD LOCK

BACKGROUND OF THE INVENTION

1. Field of the Invention

This invention relates to a cord-lock for use in the head rail of a window shade or blind for securing the position of one or more cords that are used to adjust the shade or blind height.

2. Description of the Related Art

Window coverings, such as venetian blinds and concertina blinds, typically include means for raising and lowering them to any desired height, using cords. A cord can be pulled in one direction to raise the blind. To fix the position of the blind at the desired height, the cord is released, and a mechanical cord-lock prevents the cord from moving. In order to lower the blind, the cord-lock is released, and the cord is allowed to move upwardly, allowing the blind to lower under the effects of its own weight.

Mechanical cord-locks are known, such as rollers which hold cords between them. For example, U.S. Pat. No. 4,719,956 shows a mechanical cord-lock comprising: a fixed metal cylindrical roller which serves as a guiding surface, over which a cord moves; and a second movable metal roller which serves as a locking surface. The cord is threaded between the two rollers. The movable roller, upon moving upwardly, locks the cord between the two rollers.

Another cord-lock with a guide roller and a locking roller is shown in UK patent GB (2,271,600). This cord-lock comprises a second guide roller in the elongated part of the cord-lock body which is adapted to engage the cord in the head rail of the blind. The second rotatable guide roller is intended to reduce wear of the cord and those parts of the cord-lock which are in frictional engagement with the cord.

OBJECT OF THE INVENTION

An object of this invention is to provide an improved cord-lock which has fewer component parts and which is therefore less costly to produce and stock.

SUMMARY OF THE INVENTION

According to the present invention, there is provided a cord lock for fitment to the end of a head rail of a blind, the cord lock including:

a base element;

a cap structure on the base element and together with the base element defining therebetween a cord inlet, a cord outlet and a cord passage extending therebetween;

a cord guide surface formed in the base element and extending inwardly of the cord lock from the cord outlet;

a locking roller; and at least one roller guide wall formed in the cap structure defining a path along which the locking roller may move, the path being adjacent to and inclined with the cord guide surface such that the roller moves closer to the cord guide surface whilst moving away from the cord outlet; wherein with the cord lock oriented in use such that the roller moves under gravity away from the cord guide surface, movement of a cord inwardly from the cord outlet along the cord guide surface will cause the roller to move towards the cord guide surface and pinch the cord therebetween.

In this way, a cord may effectively and selectively be locked and unlocked using only one roller and with a relatively simple structure. Furthermore, since the base element and cap structure together define the inlet, outlet and cord passage, construction is facilitated. The cord need not be threaded through the cord lock, but together with the roller may merely be placed between the base element and cap structure during assembly.

Preferably, the cord guide surface is symmetrically duplicated on the base element for selective cooperation with the roller guide walls, such that the base element is usable with symmetrically opposite cap structures, the locking roller being positioned adjacent the one of the duplicated cord guide surfaces selected according to the symmetry of the cap structure. In this way, it is possible to provide a single base element for use at either end of the head rail. According to which end of the head rail the cord lock is located, the roller guide walls of the cap structure position the locking roller so as to interact with the appropriate cord guide surface.

Preferably the cap structure includes a wall positioned adjacent the outer end of the duplicated cord guide surface which is not selected, such that there is no cord outlet for the duplicated cord guide surface which is not selected.

In this way, even though the base element has cord guide surfaces leading both forwardly and rearwardly, the cap structure provides an outlet in only one direction, such that a neat overall arrangement results.

Preferably, the base element and the cap structure are attached to one another in a plane substantially parallel to the cord guide surface. This facilitates construction, particularly with regard to positioning the cord between the base element and the cap structure.

Preferably, the cord passage is for guiding a cord to the cord inlet and into a head rail. The passage may include a cord guide channel extending generally perpendicularly to the cord guide surface and for insertion into the end of a head rail, the cord lock further including a vertical cord guide surface for directing a cord from the cord guide surface into the cord guide channel.

In this way, the cord lock may be positioned in the end of the head rail with a cord extending from inside the head rail through the cord lock and down to the side of a blind for operation by a user.

Preferably, the locking roller has an outer circumferential surface in which axially extending serrations are formed and the roller guide wall substantially opposite the cord guide surface is formed with transverse serrations so as to interact with the serrations of the locking roller.

In this way, when the locking roller pinches a cord, interaction of the serrations holds it securely in place.

The cord lock may be formed from a base element and a cap structure which are attached together.

In this way, the cord lock may be constructed easily, with the locking roller being inserted between them during assembly.

DETAILED DESCRIPTION OF THE PREFERRED EMBODIMENTS

Further aspects of the invention will be apparent from the detailed description below with reference to the accompanying drawings.

Figure 1A:
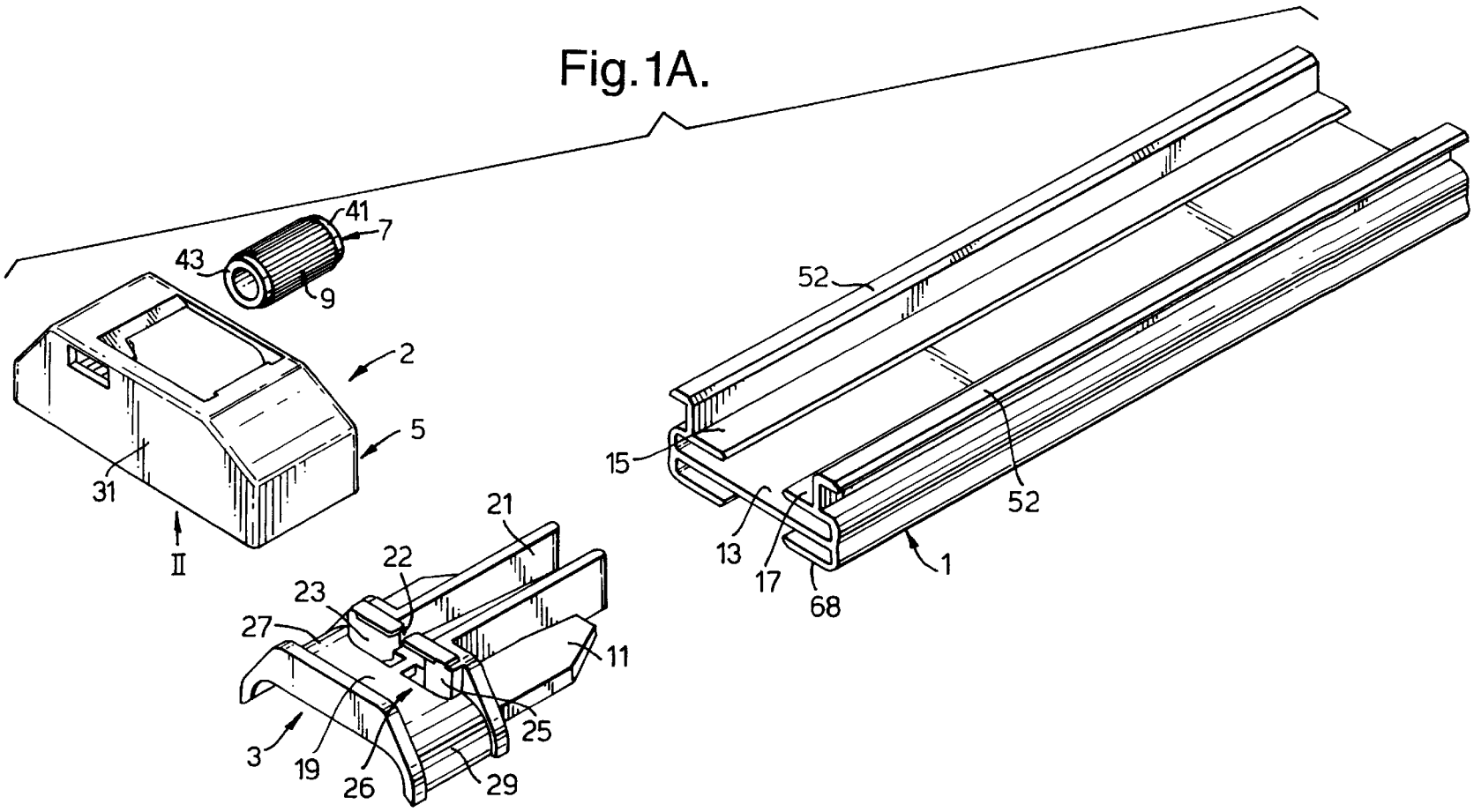
FIGS. 1A and 1B are exploded views of cord-locks in accordance with the invention in relation to a head rail profile in which they are adapted to be inserted.
Figure 1B:
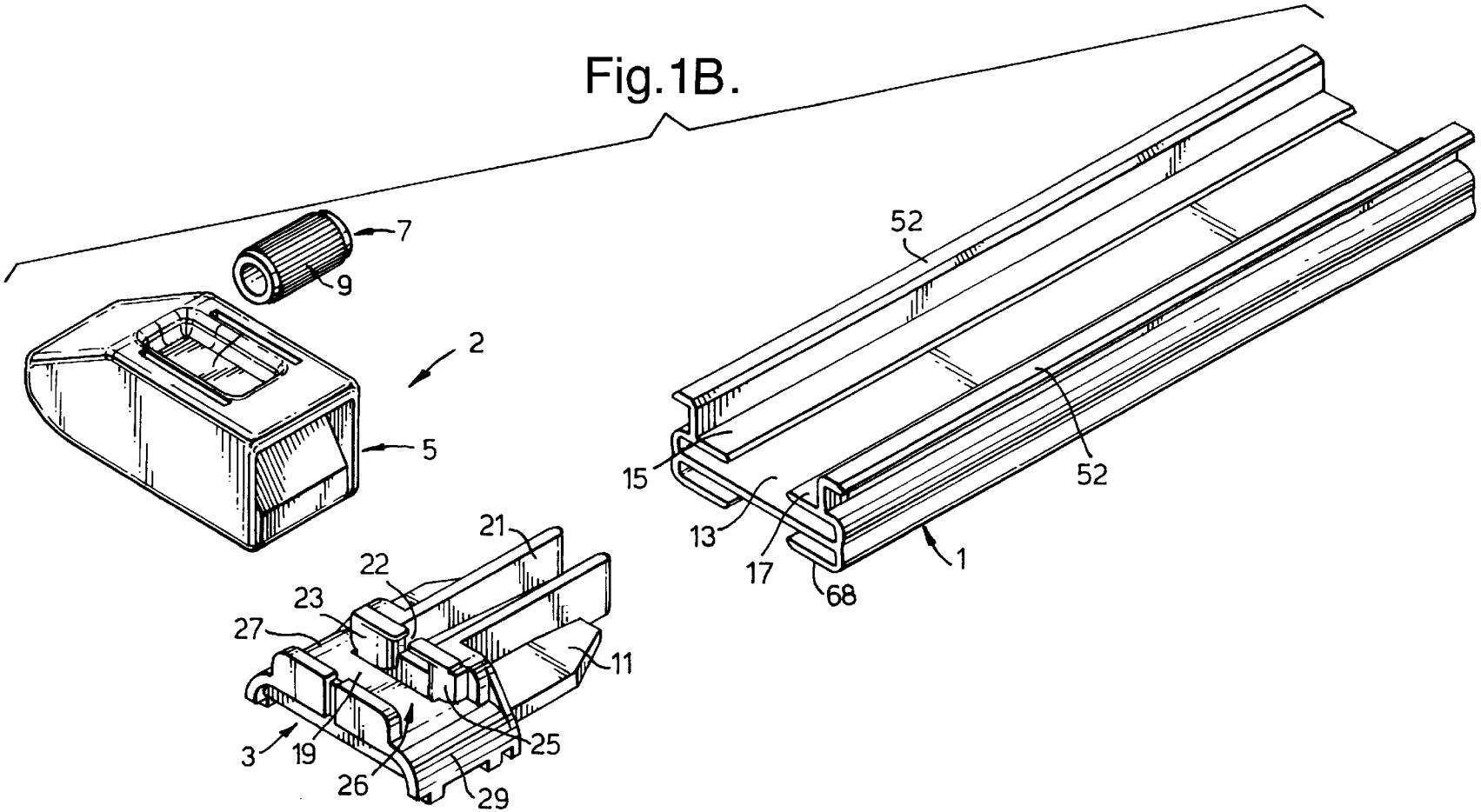

FIGS. 1A and 1B show a head rail 1 for a window blind or shade (not shown), in which can be mounted a cord-lock, generally 2, of this invention. The cord-lock of FIG. 1A is of a slightly different design to that of FIG. 1B and also symmetrically opposite. In particular, it directs a cord to the right as illustrated in the Figure, whereas that of FIG. 1B directs it to the left. The cord-lock includes a cord-lock base element 3 and a cord-lock cap structure 5 which are attached to each other to form a unitary cord-lock structure. Within the cord-lock 2, between the base element 3 and the cap structure 5, is a locking roller 7 having a plurality of axially extending serrations 9 on its outer surface.

The base 3 has a horizontal tongue structure 11 adapted to be inserted and fit within a longitudinal end of the head rail 1, between its horizontal web portion 13 and its horizontal, first and second, inwardly turned flanges 15, 17. On the horizontal side of the base 3, opposite its tongue structure 11, is a horizontal, first cord guide channel 19 adapted to guide cords through the cord-lock 2, transversely of the tongue structure 11. On top of the tongue structure 11 is a central horizontal, second cord guide channel 21, extending transversely of, and communicating with, the first cord guide channel 19. The second cord guide channel 21 provides a cord inlet for the cord-lock 2 from the head rail 1. The second cord guide channel 21 is also adapted to be inserted and fit within the longitudinal end of the head rail 1, between its horizontal, first and second, inwardly turned flanges 15, 17.

Within the first cord guide channel 19 of the base 3, about its opening 22 communicating with the second cord guide channel 21, are first and second vertical cord guide surfaces 23 and 25. The first vertical cord guide surface 23 is adapted to deflect a cord (not shown), coming from the second cord guide channel 21, rearwardly over a horizontal cord guide surface 26 at the bottom of the first cord guide channel 19 and then downwardly over a first downwardly curved cord guide surface 27 of the first cord guide channel 19. The second vertical cord guide surface 25 is adapted to deflect a cord (not shown), coming from the second cord guide channel 21, forwardly over the horizontal cord guide surface 26 and then downwardly over a second downwardly curved cord guide surface 29. Thereby, two alternative cord routings are provided by the base 3.

The structure of the base 3 and cap 5, shown in FIGS. 1A, 2A, 2B, 3A and 3B, is intended for routing operating cords frontwardly, over the second downwardly curved cord guide surface 29 of the cord-lock 2. A base 3 and cap 5 for routing operating cords rearwardly, over the first downwardly curved cord guide surface 27 of the cord-lock 2 is shown in FIG. 1B and has simply the same base 3, basically and a mirror image of the cap 5.

As shown in FIGS. 2A, 2B, 3A and 3B, one side of the outer wall 31 of the cap 5 has an opening 33 to accommodate the second cord guide channel 21. Recessed slots 35, 37 are formed in opposite sides of the cap 5 to receive the longitudinal ends 41, 43 of the locking roller 7. At the bottom rear of the cap 5, there is an inwardly turned snap ridge 39, adapted to snap the cap 5 on the base 3, where the cap 5 will engage a lower end of the first downwardly curved cord guide surface 27. Notches 45, 47 on opposite sides of the cap 5 will thereby engage the lower end of the second downwardly curved cord guide surface 29. On an inner surface of a forward end of the cap 5 are a plurality of serrations 49 adapted to cooperate with the serrations 9 on the locking roller 7.

Figure 3A:
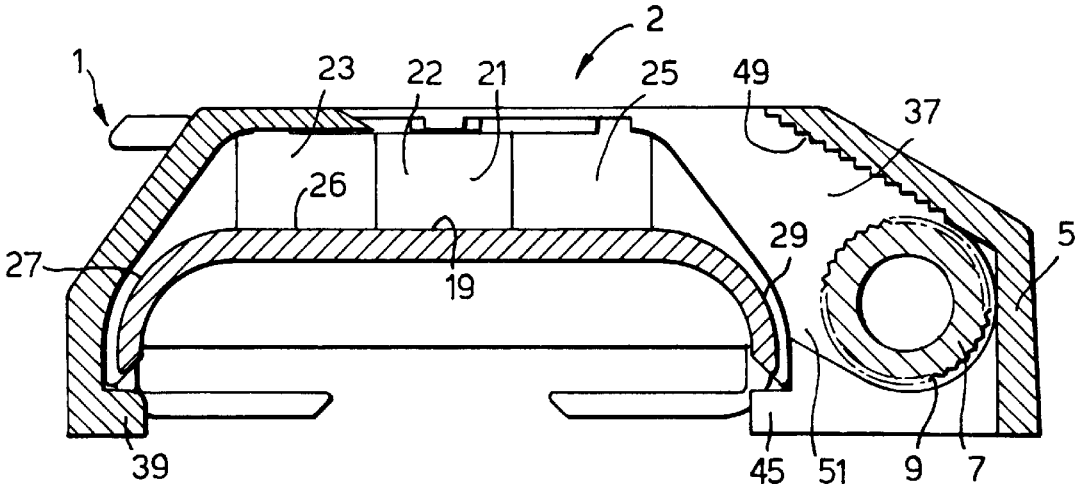
FIG. 3A is a cross-section through the assembled cord-lock of FIG. 1A, taken in a transverse direction of the head rail and looking inwardly from an end thereof

FIG. 3A shows an assembled cord-lock 2 of this invention. A cord (not shown) can be routed from the head rail 1 into the central second cord guide channel 21, then through its opening 22 to the first cord guide channel 19, then forwardly (to the right in FIG. 3A) over the second vertical cord guide surface 25, then forwardly over the horizontal cord guide surface 26 and then downwardly through a gap 51 between the second downwardly curved surface 29 and the locking roller 7.

The operation of the cord-lock 2 of FIGS. 1–3 is as follows. When a cord (not shown) is pulled downwardly through the gap 51 between roller 7 and the second downwardly curved surface 29, a blind can be raised. When the cord is released, it will start to move relatively upwardly under the weight of the blind. The upwardly moving cord can then be pulled forwardly (to the right in FIGS. 3A and B) to engage locking roller 7, the ends 41, 43 of which then will move generally upwardly and rearwardly (to the left in FIGS. 3A and B) within the slots 35, 37 to move the roller 7 upwardly and rearwardly into its locking position. In the locking position (not shown), the serrations 9 of the locking roller 7 engage the serrations 49 of the cap 5 to clamp the cord (not shown) against the second downwardly curved surface 29 because the gap 51 between the roller 7 and the second downwardly curved surface 29 becomes gradually less as the roller moves in an upward and rearward direction.

In order to lower the blind, the cord (not shown) is pulled in a downward direction, and this unlocks roller 7, which then falls under its own weight and the ends 41, 43 of which move generally downwardly and frontwardly (to the right in FIGS. 3A and B) to the bottom of slots 35, 37. The cord is than free to be pulled upwardly or downwardly again to raise or lower the blind.

Figure 2A:
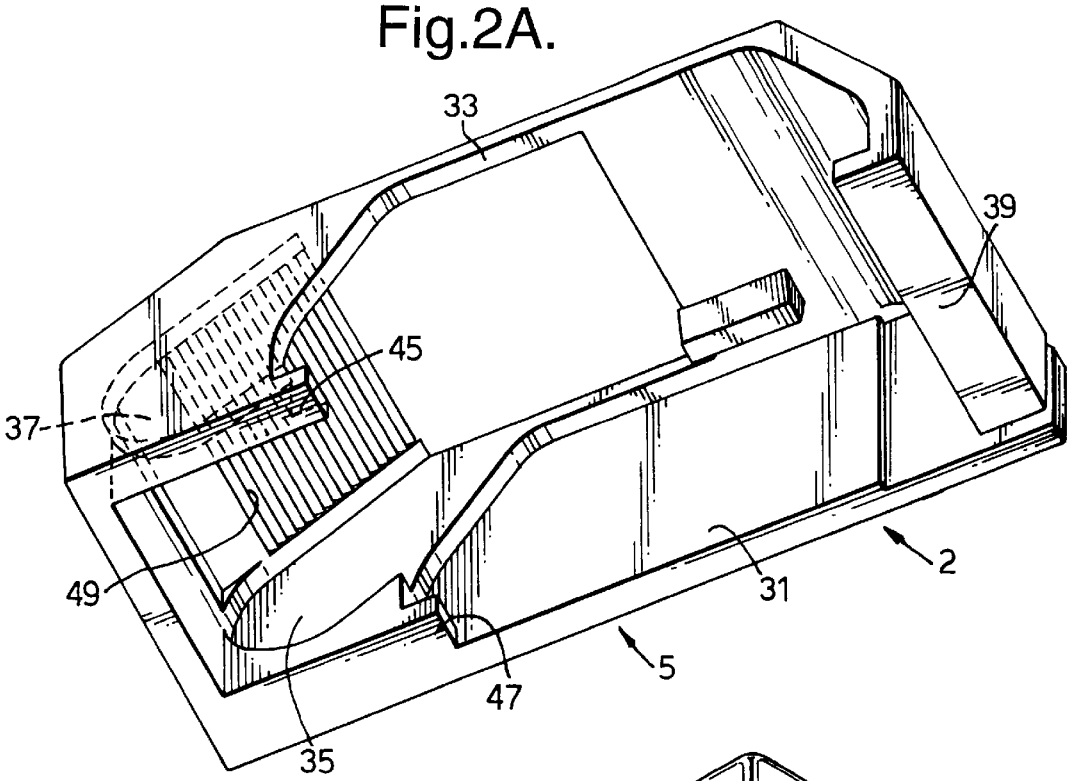
FIGS. 2A and 2B are ghost views from underneath the cap structure of cord-locks.
Figure 2B:
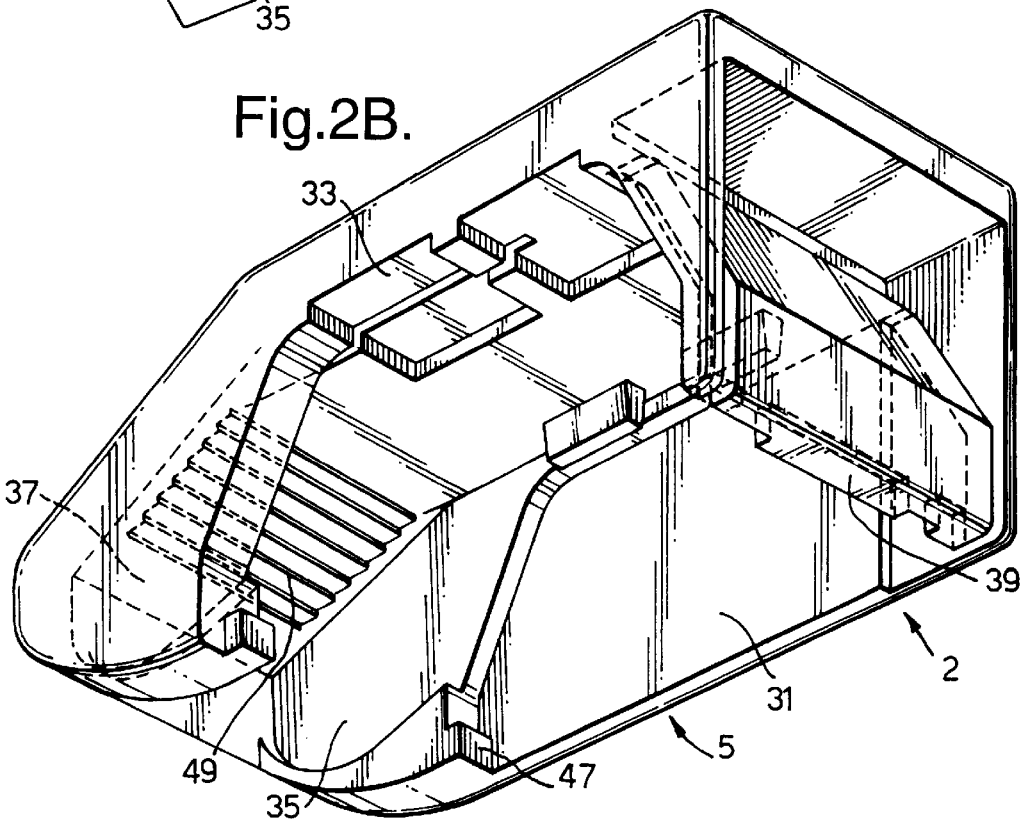
Figure 3B:
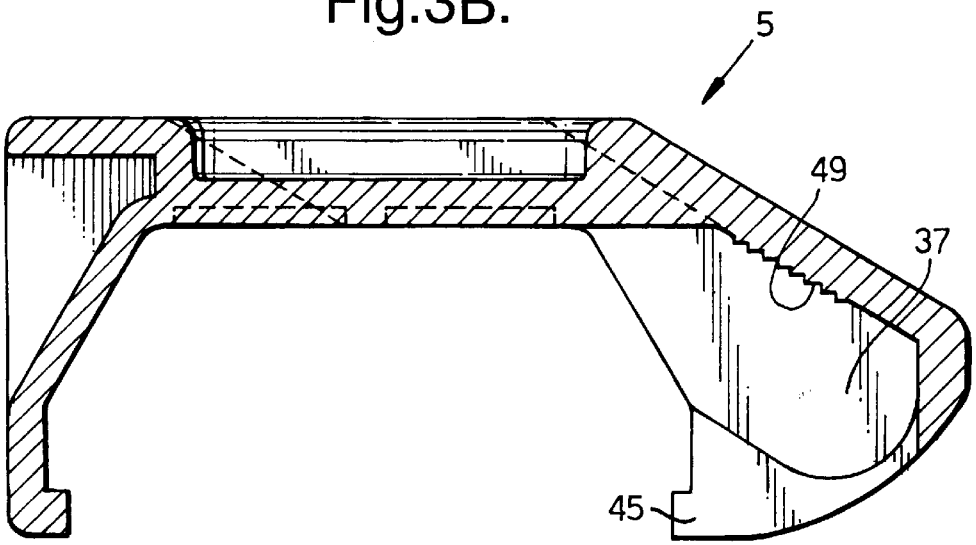
FIG. 3B is a similar view of the cap structure of FIG. 2B alone.

It will be seen that in FIGS. 1B, 2B and 3B the cord lock assembly 2 is of a slightly different form to that illustrated in FIGS. 1A, 2A and 3A. For example, it does not include a central opening on its upper surface, but merely has an indented portion 66. Other minor variations are also present. For instance, the inwardly turned snap bridge 39 illustrated in FIG. 2A need not extend all of the way to the opening 33. In other words, as shown in FIG. 2B, the snap bridge 39 may be separated from a wall forming the opening 33 just as it is separated from the outer wall 31. In this way, engagement with the base 3 is inset slightly from the opening 33 and the notch 45 is similarly inset.

Various different standards are known for attaching head rails to window openings, etc. For instance, the cross-section of the head rail 1 illustrated in FIGS. 1A and B includes some outwardly extending flanges 52. These flanges 52 are intended to be received by appropriately arranged attachment members which have previously been secured for instance above windows.

Figure 4:
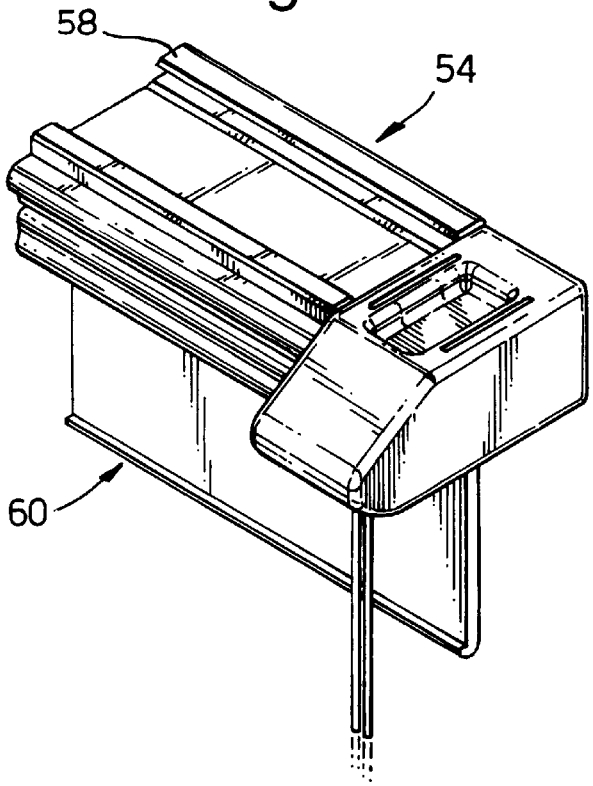
FIG. 4 illustrates the cord lock assembly of FIG. 1B fitted to a head rail, together with an adapter rail and an attachment rail.
Figure 5:
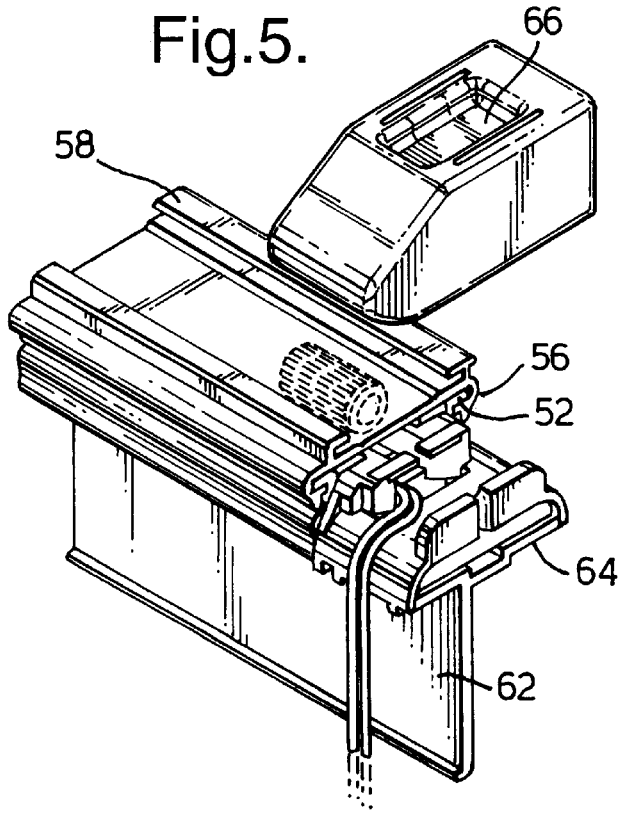
FIG. 5 illustrates the arrangement of FIG. 4 with the cord lock cap and locking roller separated.

So that the head rail 1 may be used with different attachment members, it is proposed to provide an adapter rail 54, illustrated in FIGS. 4 and 5, to engage with the head rail 1 and provided with appropriate means for engaging with the attachment members of the different system.

For the illustrated examples, the adapter rail 54 includes inwardly extending flanges 56 for engaging the outwardly extending flanges 52 of the head rail 1. Furthermore, it includes inwardly extending flanges 58 for engaging attachment members of the appropriate system.

FIGS. 4 and 5 also illustrate an attachment rail 60 which can be used for certain types of blinds.

The illustrated example includes a downwardly extending section 62 onto which the material of the blind may be attached. The downwardly extending section 62 extends from a transverse section 64 which is arranged to engage with the head rail 1. In particular, as illustrated in FIGS. 1A and B, the head rail 1 has two inwardly extending flanges 68 which are arranged to form a channel into which the transverse section 64 fits.

Of course, the attachment rail 60 may be formed in a different manner for attachment to a blind and may engage with the head rail 1 in a different manner.

The cord-lock 2, particularly its base element 3, is preferably made from a material that resists wear from repeated cord abrasion and that has a low coefficient of friction. Suitable materials are metal alloys, such as ZAMAC or plastics such as ULTEM.

The invention is, of course, not limited to the above-described embodiment which may be modified without departing from the scope of the invention or sacrificing all of its advantages. In this regard, the terms in the foregoing description and the claims which follow, such as "upper", "lower", "frontwardly", "rearwardly", "upwardly", "downwardly", "right" and "left", have been used only as relative terms to describe the relationships of the various elements of the cord-lock of the invention.

We claim:

1. A cord lock for fitment to the end of a head rail of a blind, the cord lock including:

a base element;

a cap structure on the base element and together with the base element defining therebetween a cord inlet, a cord outlet and a cord passage extending between the cord inlet and cord outlet;

a cord guide surface formed on the base element and extending inwardly of the cord lock from the cord outlet;

a locking roller; and at least one roller guide slot formed in the cap structure defining a path that is inclined relative to vertical and along which the movement of the locking roller is guided the path defining a roller guide wall along which the roller rolls with the guide wall being adjacent to and disposed relative to the cord guide surface such that the roller moves closer to the cord guide surface when moving from the cord outlet toward the cord inlet.

2. A cord lock according to claim 1 wherein the cord guide surface has two sides and is symmetric on the base element for selective cooperation with the roller guide wall, such that the base element is usable with symmetrically opposite cap structures, the locking roller being positioned adjacent one end of the cord guide surface selected according to the orientation of the cap structure.

3. A cord lock according to claim 2 wherein the cap structure includes a wall positioned adjacent one end of the cord guide surface such that there is no cord outlet at said one end of the cord guide surface.

4. A cord lock according to claim 1, wherein the cord passage is for guiding a cord to the cord inlet and into a head rail.

5. A cord lock according to claim 4 wherein the passage includes a cord guide channel extending generally perpendicular to the cord guide surface and for insertion into the end of a head rail, the cord lock further including a vertical cord guide surface for directing a cord from the cord guide surface into the cord guide channel.

6. A cord lock according to claim 1, wherein the locking roller has an outer circumferential surface with axially extending serrations.

7. A cord lock according to claim 6 wherein said roller guide wall is substantially opposite the cord guide surface and has transverse serrations so as to interact with the serrations of the locking roller.

8. A cord lock according to claim 1 wherein there are two of said roller guide slots formed in the cap structure on opposite sides of the cap structure to receive the ends of the locking roller.

9. The cord lock of claim 7 wherein said cord guide surface is curved from said cord inlet toward said cord outlet.

10. The cord lock of claim 7 or 8 wherein said cord guide surface is free of serrations.

11. A blind assembly including a head rail for supporting a blind or shade and at least one cord lock, said cord lock including:

a base element;

a cap structure on the base element and together with the base element defining therebetween a cord inlet, a cord outlet and a cord passage extending between the cord inlet and the cord outlet;

a cord guide surface formed on the base element and extending inwardly of the cord lock from the cord outlet;

a locking roller; and at least one roller guide slot formed in the cap structure defining a path that is inclined relative to vertical and along which the movement of the locking roller is guided, the path defining a roller guide wall along which the roller rolls with the guide wall being adjacent to and disposed relative to the cord guide surface such that the roller moves closer to the cord guide surface when moving from the cord outlet toward the cord inlet.

12. A blind assembly according to claim 11 further including an adapter rail, the head rail having a flange arrangement allowing it to be supported from above in use, the adapter rail having two sides, one side being arranged to engage with the flange arrangement of the head rail and the other side having a flange arrangement different to that of the head rail for allowing the adapter rail to be supported from above in use.

13. A blind assembly according to claim 12 further including an attachment rail onto which a blind or shade may be attached and provided with a flange arrangement for engagement with the head rail.

* * * * *